US006586919B2

(12) United States Patent
Viehmann

(10) Patent No.: US 6,586,919 B2
(45) Date of Patent: Jul. 1, 2003

(54) VOLTAGE-CURRENT CONVERTER

(75) Inventor: Hans-Heinrich Viehmann, South Burlington, VT (US)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/219,601

(22) Filed: Aug. 15, 2002

(65) Prior Publication Data

US 2003/0020446 A1 Jan. 30, 2003

Related U.S. Application Data

(63) Continuation of application No. PCT/DE01/00333, filed on Jan. 26, 2001.

(30) Foreign Application Priority Data

Feb. 15, 2000 (EP) ..... 00103077

(51) Int. Cl.[7] ..... G05F 3/16
(52) U.S. Cl. ..... 323/315; 327/103
(58) Field of Search ..... 323/312, 315; 363/73; 327/103, 530, 538, 543

(56) References Cited

U.S. PATENT DOCUMENTS 4,004,247 A * 1/1977 Van de Plassche ..... 330/257
4,675,594 A * 6/1987 Reinke ..... 323/317
4,961,009 A 10/1990 Baik
5,021,730 A * 6/1991 Smith ..... 323/316
5,337,021 A 8/1994 Zarabadi et al.
5,404,097 A * 4/1995 Barou ..... 323/312
5,519,309 A * 5/1996 Smith ..... 323/316
5,519,310 A * 5/1996 Bartlett ..... 323/316
5,552,729 A * 9/1996 Deguchi ..... 327/103
5,619,125 A * 4/1997 Lakshmikumar ..... 323/315
5,754,039 A 5/1998 Nishimura
5,917,368 A * 6/1999 Tan et al. ..... 327/543
5,986,910 A * 11/1999 Nakatsuka ..... 363/73
6,060,870 A * 5/2000 Seevinck ..... 323/273
6,219,261 B1 * 4/2001 Stochino ..... 363/73
6,388,507 B1 * 5/2002 Hwang et al. ..... 327/538
6,420,912 B1 * 7/2002 Hsu et al. ..... 327/103

FOREIGN PATENT DOCUMENTS

EP 0 337 444 A2 10/1989
EP 0 454 243 A1 10/1991
EP 0 740 243 A2 10/1996

OTHER PUBLICATIONS

Seifart, M.: "Analoge Schaltungen" [Analog Circuits], Verlag Technik GmbH, 1996, pp. 159–161.

* cited by examiner

*Primary Examiner*—Adolf Denske Berhane
(74) *Attorney, Agent, or Firm*—Laurence A. Greenberg; Werner H. Stemer; Ralph E. Locher

(57) ABSTRACT

The invention concerns a voltage-current converter having: a first current mirror containing two transistors that are designed such that under identical drive conditions the current flowing through the first transistor is greater than the current flowing through the second transistor by a predetermined factor. The current through the second transistor constitutes the output current of the voltage-current converter. The very large area required in integrated circuits for known voltage-current converters is reduced by providing a second current mirror containing two transistors. The two current mirrors are connected in series to a supply voltage. A MOSFET is connected in series with the first transistor of the first current mirror. The gate of the MOSFET is connected to the input voltage.

4 Claims, 1 Drawing Sheet

VOLTAGE-CURRENT CONVERTER

CROSS-REFERENCE TO RELATED APPLICATION

This application is a continuation of copending International Application No. PCT/DE01/00333, filed Jan. 26, 2001, which designated the United States and was not published in English.

BACKGROUND OF THE INVENTION

Field of the Invention

The invention concerns a voltage-current converter having a first current mirror containing two transistors that are designed such that under identical drive conditions the current flowing through the first transistor is greater than the current flowing through the second transistor, which constitutes the output current of the voltage-current converter, by a predetermined factor.

Voltage-current converters are well-known in the prior art, and are used for converting an input voltage into a proportional output current. This is required, for example, for the voltage-controlled oscillator (VCO) in a phase-locked loop (PLL).

The voltage-current converter that is known in the art and that has been mentioned above is shown in FIG. 2. It contains a current mirror 10 having two normally-off n-channel MOSFETs 12, 14 (metal-oxide-semiconductor field-effect transistors). The current mirror 10 is programmed using a series resistor 16 that is connected in series with the drain of the first transistor 12 to the input voltage $U_E$. The series resistor 16 determines the drain current $I_{12}$ of the first transistor 12, and this drain current $I_{12}$ constitutes the input current $I_E$ of the current mirror 10.

The gates of the two transistors 12, 14 are connected together and are also connected to the drain of the first transistor 12, so that both transistors 12, 14 are driven under the same conditions. The source of the first transistor 12 is connected to ground. The source of the second transistor 14 is connected to ground, and the output current $I_A$ of the voltage-current converter is taken from the drain of the second transistor 14.

The current mirror 10 is disclosed in FIG. 6.21 in the book SEIFART, MANFRED, *Analoge Schaltungen-5. Auflage* (*Analog circuits-5th Edition,* Verlag Technik GmbH, Berlin, 1996, DE (ISBN 3-341-01175-7). The circuit shown in FIG. 2 is different from the voltage-current converter that is known from Seifart in that the input voltage $U_E$ is connected to the series resistor 16 instead of to the supply voltage $U_{DD}$. Consequently, the input voltage $U_E$ is proportional to the input current $I_E$ in accordance with the resistance value of the series resistor 16.

Since the transistors 12, 14 are operated in the saturation region, their respective drain currents $I_{12}$, $I_{14}$ are proportional to each other. Provided the remaining parameters, such as the surface mobility of the charge carriers in the channel $\mu_0$, the gate capacitance per surface area $C_{0x}$ and the threshold voltage $U_T$, are identical for the transistors 12, 14, then this proportionality can be set simply by selecting the geometrical dimensions of the transistors 12, 14. In this case the following equation holds for the two drain currents $I_{12}$ and $I_{14}$:

$$I_{14}/I_{12}=\beta_{14}/\beta_{12},$$

where $\beta$=W/L is the geometrical quotient of a transistor of channel width W and channel length L.

If the layout of the first transistor 12 and the second transistor 14 on the chip is such that the geometrical dimensions result in the equation $\beta_{12}=10\cdot\beta_{14}$, for instance, by the channel of the first transistor 12 being made the same length but ten times wider than the channel of the second transistor 14, then one accordingly obtains the relationship $I_{12}=10\cdot I_{14}$.

Thus in this case, because of the aforementioned proportionality between the input voltage $U_E$ and the input current $I_E \equiv I_{12}$, the drain current $I_{14}$ of the second transistor 14, which constitutes the output current $I_A$ of the known voltage-current converter, is proportional to the input voltage $U_E$.

Since in the cited applications of the phase-locked loop, the input voltage $U_E$ normally lies in the range of 2 to 5 volts, and the required output current intensity $I_A$ is meant to lie in the region of a few nanoamps, the series resistor 16 must have a resistance value in the region of several megaohms (MΩ). Resistances of this order of magnitude, however, require a very large area in integrated circuits, which is a major disadvantage because the costs of integrated circuits are mainly determined by the area requirement.

SUMMARY OF THE INVENTION

It is accordingly an object of the invention to provide a voltage-current converter which overcomes the above-mentioned disadvantages of the prior art apparatus of this general type.

With the foregoing and other objects in view there is provided, in accordance with the invention, a voltage-current converter with a first current mirror including a first transistor and a second transistor each being designed such that under identical drive conditions a current flowing through the first transistor is greater than a current flowing through the second transistor by a predetermined factor; a second current mirror including a first transistor and a second transistor; and a MOSFET connected in series with the first transistor of the first current mirror. The MOSFET has a gate connected to an input voltage. The current flowing through the second transistor is an output current of the voltage-current converter. The first transistor of the first current mirror and the first transistor of the second current mirror are connected in series to a supply voltage. The second transistor of the first current mirror and the second transistor of the second current mirror are connected in series to the supply voltage.

In accordance with an added feature of the invention, a current flowing through the first transistor of the second current mirror is equal to a current flowing through the second transistor of the second current mirror.

In accordance with an additional feature of the invention, the first transistor of the first current mirror and the second transistor of the first current mirror are operated in weak inversion.

In accordance with another feature of the invention, the MOSFET has a threshold voltage such that the voltage-current characteristic starts at 0.

In particular, it is an object of the invention to provide a voltage-current converter that requires less area that that required by known voltage-current converters.

In the voltage-current converter, the series resistor 16 previously required in the voltage-current converter known in the art is dispensed with, and since the MOSFET that is now provided occupies a considerably smaller area in an IC compared with a resistor, a considerable area savings is obtained, even though more components are provided compared with the voltage-current converter known in the art.

In order to simplify the explanation of how this voltage-current converter works, it is assumed below that in the second current mirror the two transistors are identical, which here implies that currents of equal magnitude flow through them under identical drive conditions. In addition it is assumed that the factor equals ten.

If the first current mirror were considered on its own, currents of different magnitudes would flow through its two transistors under the same drive conditions, or more precisely the current through the first transistor would equal ten times the current through the second transistor in accordance with the factor. In other words, the first transistor has a conductance that is ten times the conductance of the second transistor in accordance with the factor.

This first current mirror is not on its own, however, but is connected in series with the second current mirror to the supply voltage, which, like the input voltage, lies normally in the range 2 to 5 volts. The two first transistors are connected in series and form the input-current path of the voltage-current converter. The two second transistors are connected in series and form the output-current path of the voltage-current converter. The two identical transistors of the second current mirror ensure that currents of equal magnitude also flow through the two non-identical transistors of the first current mirror. Since this has no effect on their conductances, however, the voltage drop across the first transistor is only one tenth of the voltage drop across the second transistor in accordance with the factor. The remaining voltage, i.e. the difference between these two voltages, falls finally across the MOSFET that is connected in series with the first transistor, and thus constitutes its drain-source voltage.

This drain-source voltage remains constant to a close approximation and equals, for example, 60 mV. This value is selected with regard to the previously mentioned input-voltage range of 2 to 5 volts, and is small enough to be less than the gate drive voltage of the MOSFET, i.e. the difference between the gate-source voltage applied across it, which is in fact formed by the input voltage, and its threshold voltage. The MOSFET is consequently being operated in strong inversion, so that it lies in the resistive region of the output characteristic, also referred to as the "linear region" or "active region".

In the resistive region, the drain current is proportional to the drain-source voltage to a good approximation. Because of this proportionality, the channel of the MOSFET can thus be assigned a resistance or conductance. This conductance is itself proportional to the gate drive voltage. An increase in the input voltage, and hence the gate drive voltage, therefore effects a proportional increase in the conductance and hence also in the drain current. Since the drain current programs the first current mirror, the current flowing through the second transistor, which in fact forms the output current of the voltage-current converter, is consequently also increased proportionally, but in accordance with the factor, the output current remains at just one tenth of the current through the first transistor. Thus the output current is proportional to the input voltage, as is expected of course from a voltage-current converter.

Preferably, provision is made for the first current mirror to contain a third transistor that is connected to ground, where the current flowing through it, rather than the current flowing through the second transistor, now constitutes the output current of the voltage-current converter. This third transistor therefore acts as an output transistor, so that the input voltage is not loaded by the output current. This achieves a higher input resistance for the voltage-current converter. In addition, using this third transistor, the output current can be scaled to the required order of magnitude independently of the second transistor.

Preferably, in the second current mirror, the current flowing through the first transistor is equal to the current flowing through the second transistor. This simplifies the design of the circuit and the layout.

Preferably, in the first current mirror, the first transistor and the second transistor are operated in weak inversion. As a result, the drain-source voltage remains constant over a large range of several decades, improving the accuracy of the voltage-current converter.

Other features which are considered as characteristic for the invention are set forth in the appended claims.

Although the invention is illustrated and described herein as embodied in a voltage-current converter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
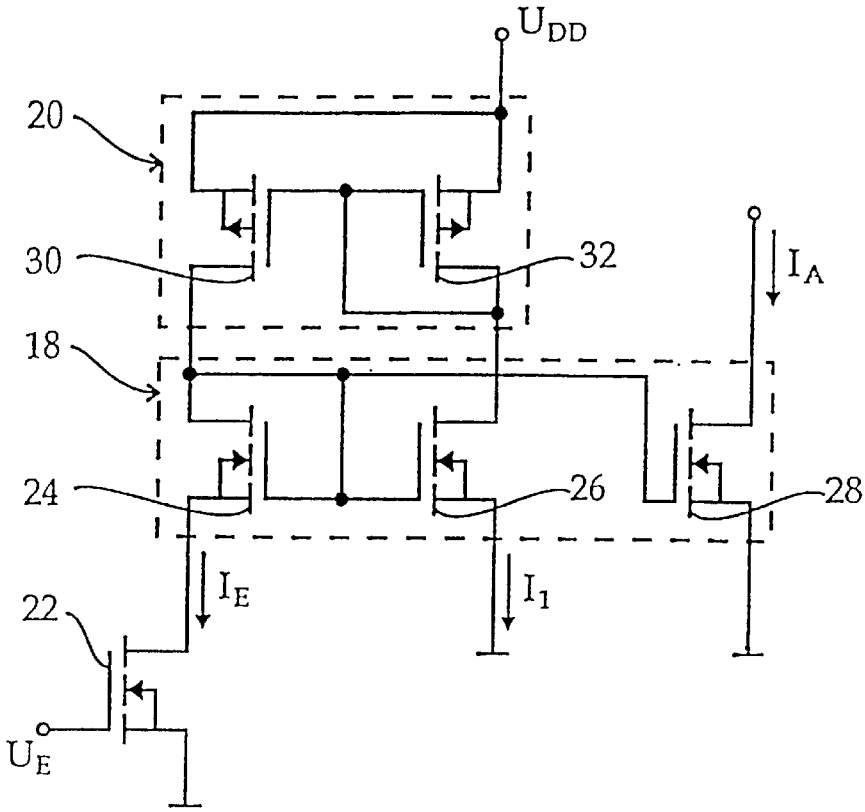
FIG. 1 is a circuit diagram of a preferred embodiment of a voltage-current converter.
Figure 2:
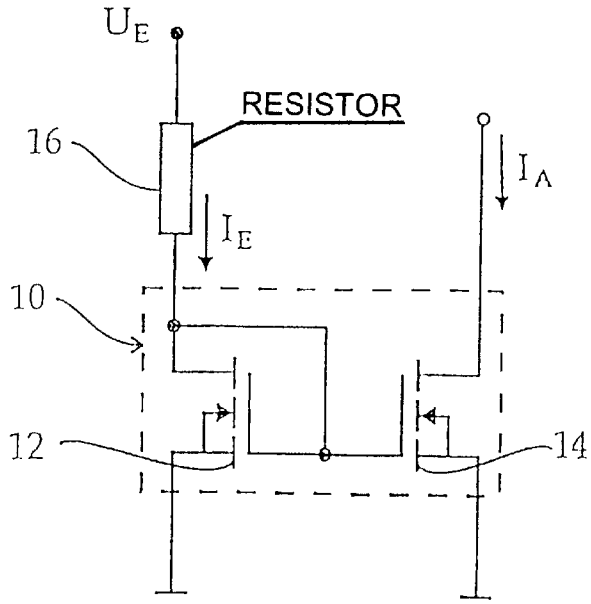
FIG. 2 PRIOR ART
FIG. 2 is a circuit diagram of a prior art voltage-current converter.

Referring now to the figures of the drawing in detail and first, particularly, to FIG. 1 thereof, there is shown a preferred embodiment of a voltage-current converter containing a first current mirror 18, a second current mirror 20, and a MOSFET 22. In the embodiment shown, this MOSFET 22 has a normally-off n-channel. Its source is connected to ground, and the input voltage $U_E$ of the voltage-current converter is applied to its gate and therefore forms the gate-source voltage $U_{GS}$.

The first current mirror 18 contains three transistors 24, 26, 28, which in the embodiment shown are also normally-off n-channel MOSFETs operated in the saturation region. Their gates are connected together and to the drain of the first transistor 24, so that all three transistors 24, 26, 28 have the same drive conditions. The source of the first transistor 24 is connected to the drain of the MOSFET 22, so that the first transistor 24 and the MOSFET 22 are connected in series. The source of the second transistor 26 is connected to ground. The source of the third transistor 28 is connected to ground. The output current $I_A$ of the voltage-current converter is taken from the drain of the third transistor 28. The first current mirror 18 is thus programmed by the channel resistance of the MOSFET 22.

The shown second current mirror 20 contains two transistors 30, 32, which in the embodiment shown are normally-off p-channel MOSFETs operated in the saturation region. Their gates are connected together and to the drain of the second transistor 32 of second current mirror 20, so that both transistors 30, 32 have the same drive conditions. Their sources are connected to the supply voltage $U_{DD}$. The drain of the first transistor 30 of second current mirror 20 is connected to the drain of the first transistor 24 of the first current mirror 18, while the drain of the second transistor 32 of second current mirror 20 is connected to the drain of the second transistor 26 of the first current mirror 10, so that the two first transistors 24, 30 and the two second transistors 26, 32 respectively are connected in series to the supply voltage $U_{DD}$.

In this preferred embodiment, the three transistors 24, 26, 28 in the first current mirror 18 are designed such that for the same drive conditions, the drain current $I_{24}$ flowing through the first transistor 24 is greater than the drain current $I_{26}$ flowing through the second transistor 26 by a predetermined first factor $K_1$, and is greater than the drain current $I_{28}$ flowing through the third transistor 28 by a predetermined second factor $K_2$. In other words, the first transistor 24 has a channel conductance $G_{24}$ that is $K_1$ times the channel conductance $G_{26}$ of the second transistor 26, and $K_2$ times the channel conductance $G_{28}$ of the third transistor 28. This can simply be achieved by selecting suitable geometrical dimensions for the three transistors 24, 26, 28 given otherwise identical parameters, so that their geometrical quotients $\beta_{24}$, $\beta_{26}$, $\beta_{28}$ are also in the specified proportional ratios. Hence the following equations hold:

$$K_1=I_{24}/I_{26}=G_{24}/G_{26}=\beta_{24}/\beta_{26}$$

and $$K_2=I_{24}/I_{28}=G_{24}/G_{28}=\beta_{24}/\beta_{28}$$

In addition, in this preferred embodiment the two transistors 30, 32 in the second current mirror 20 have an identical design in the sense specified above, so that under identical drive conditions the drain current $I_{30}$ flowing through the first transistor 30 is equal to the drain current $I_{32}$ flowing through the second transistor 32. Consequently, their channel conductances $G_{30}$, $G_{32}$ are also identical. This can simply be achieved by selecting suitable geometrical dimensions for the two transistors 30, 32 given otherwise identical parameters, so that their geometrical quotients $\beta_{30}$, $\beta_{32}$ are also identical.

The way in which the shown voltage-current converter works is described below. In this description, the path taken by the supply voltage $U_{DD}$ to ground via the first transistor 30 of the second current mirror 20, the first transistor 24 of the first current mirror 18 and the MOSFET 22 is referred to as the "input current path" of the voltage-current converter, while the path taken by the supply voltage $U_{DD}$ to ground via the second transistor 32 of the second current mirror 20 and the second transistor 26 of the first current mirror 18 is referred to as the "output current path" of the voltage-current converter.

The second current mirror 20, with its identical transistors 30, 32, ensures that the current $I_E$ in the input current path, and the current $I_1$ in the output current path, are equal in magnitude. In the first current mirror 18, however, these equal currents $I_E$, $I_1$ cause a voltage drop $U_{24}$ across the first transistor 24 that is smaller than the voltage drop $U_{26}$ falling across the second transistor 26 by the aforesaid conductance ratio $K_1=G_{24}/G_{26}$, in accordance with the equation $U=R\cdot I=I/G$. Hence it follows that:

$$K_1=U_{26}/U_{24}$$

Since both current paths run in parallel from the supply voltage $U_{DD}$ to ground, the total voltage drop across them is the same and equals the supply voltage $U_{DD}$. Thus in the output current path the following holds:

$$U_{DD}=U_{32}+U_{26}$$

On the other hand, since $U_{30}=U_{32}$ but $U_{24}<U_{26}$, in the input current path the following must be true:

$$U_{30}+U_{24}<U_{DD}$$

The MOSFET 22 is also present here, however, and the remaining voltage falls across this as its drain-source voltage $U_{DS}$, so that the following holds:

$$U_{DD}=U_{30}+U_{24}+U_{DS}$$

The first factor $K_1$ is now selected using the geometry quotients $\beta_{24}$, $\beta_{26}$ such that the MOSFET 22 is operated in the resistive region. The following must therefore apply:

$$U_{DS}<U_{GS}-U_T\equiv U_{eff}$$

where $U_{GS}$ is the gate-source voltage formed by the input voltage $U_E$, $U_T$ is the threshold voltage and $U_{eff}$ is the gate drive voltage.

Conversely, the first current mirror 18 is programmed by the channel conductance $G_{22}$ of the MOSFET 22, because the MOSFET 22 lies in the input current path. This means that the current $I_E$ in the input current path, which also flows through the MOSFET 22, determines the drain current $I_{26}$ through the second transistor 26 of the first current mirror 18, and hence also the current $I_1$ in the output current path and the drain current $I_{28}$ through the third transistor 28 of the first current mirror 18. Therefore, because of the aforementioned equation $K_2=I_{24}/I_{28}$, it holds that:

$$I_{28}=I_{24}/K_2=I_E/K_2.$$

This drain current $I_{28}$ through the third transistor 28 constitutes the output current $I_A$ of the voltage-current converter, so that the second geometrical quotient $K_2$ can be selected such that the output current $I_A$ lies in the required order of magnitude.

Since in the resistive region the gate drive voltage $U_{eff}\equiv U_E-U_T$ is proportional to the channel conductance $G_{22}$, and this is in turn proportional to the drain current $I_E$ according to the equation $I=G\cdot U$, then the following holds for the MOSFET 22:

$$U_E\approx I_E.$$

Finally, because of the programming and given that $I_E\approx I_{28}\equiv I_A$, it also follows from this that:

$$U_E\approx I_A;$$

i.e. the proportionality between the output current $I_A$ and the input voltage $U_E$ that is required for a voltage-current converter is obtained.

The transistors 30, 32 of the second current mirror 20 do not need to be identical; instead, like the transistors 24, 26, 28 of the first current mirror 18, they can differ by a factor, for example.

In addition, the type of the transistors 24, 26, 28, 30, 32 of the two current mirrors 18, 20 is not restricted to the MOSFETs described; instead they can for instance be MOSFETs of a different polarity and/or doping, or even JFETs (Junction Field effect Transistors) or bipolar transistors.

I claim:

1. A voltage-current converter, comprising:

a first current mirror including a first transistor and a second transistor each being designed such that under identical drive conditions a current flowing through said first transistor is greater than a current flowing through said second transistor by a predetermined factor, said current flowing through said second transistor being an output current of the voltage-current converter;

a second current mirror including a first transistor and a second transistor; and a MOSFET connected in series with said first transistor of said first current mirror, said MOSFET having a gate connected to an input voltage;

said first transistor of said first current mirror and said first transistor of said second current mirror being connected in series to a supply voltage; and said second transistor of said first current mirror and said second transistor of said second current mirror being connected in series to the supply voltage.

2. The voltage-current converter according to claim 1, wherein:

a current flowing through said first transistor of said second current mirror is equal to a current flowing through said second transistor of said second current mirror.

3. The voltage-current converter according to claim 1, wherein:

said first transistor of said first current mirror and said second transistor of said first current mirror are operated in weak inversion.

4. The voltage-current converter according to claim 1, wherein:

said MOSFET has a threshold voltage such that a voltage-current characteristic starts at 0.

* * * * *